US009457261B2

(12) United States Patent
Vaioli et al.

(10) Patent No.: US 9,457,261 B2
(45) Date of Patent: Oct. 4, 2016

(54) BOWLING PROCESS AND SYSTEM FOR PROVIDING PICTORIAL REPRESENTATIONS OF A SCORE

(71) Applicant: QubicaAMF Europe SPA, Bologna (IT)

(72) Inventors: Roberto Vaioli, Ozzano dell'Emilia (IT); Massimo Baraldi, Bologna (IT); Dario Fergacich, Bologna (IT); Danilo Mai, San Giorgio di Piano (IT); Stefano Pancaldi, Minerbio (IT)

(73) Assignee: QUBICAAMF EUROPE SPA, Bologna (IT)

( * ) Notice: Subject to any disclaimer, the term of this patent is extended or adjusted under 35 U.S.C. 154(b) by 22 days.

(21) Appl. No.: 14/086,165

(22) Filed: Nov. 21, 2013

(65) Prior Publication Data

US 2014/0200088 A1 Jul. 17, 2014

(51) Int. Cl.
*A63D 5/04* (2006.01)
*A63F 13/00* (2014.01)

(52) U.S. Cl.
CPC ..... *A63D 5/04* (2013.01); *A63F 13/005* (2013.01)

(58) Field of Classification Search
CPC ..... A63D 5/04; A63F 13/005
USPC ..... 473/54, 70, 71; 463/13, 16; 700/91, 92
See application file for complete search history.

(56) References Cited

U.S. PATENT DOCUMENTS 4,225,924 A 9/1980 Trujillo
5,241,379 A 8/1993 Tsujita
5,255,185 A 10/1993 Mowers et al.
5,437,575 A * 8/1995 Douglass, Jr. ..... 473/54
5,577,971 A * 11/1996 File ..... 473/54
5,842,929 A 12/1998 Moody et al.
5,882,263 A * 3/1999 Chung ..... 473/70
5,899,815 A * 5/1999 Helou et al. ..... 473/54
6,017,278 A * 1/2000 Benko ..... 473/70
6,048,272 A * 4/2000 Tsujita ..... 473/70

(Continued)

FOREIGN PATENT DOCUMENTS

CN 202036773 U 11/2011
EP 2170472 4/2010

OTHER PUBLICATIONS

Final Office Action for related U.S. Appl. No. 14/086,149, dated Aug. 14, 2015, 11 pages.

(Continued)

*Primary Examiner* — William Pierce
(74) *Attorney, Agent, or Firm* — Andrew M. Calderon; Roberts Mlotkowski Safran Cole & Calderon, P.C.

(57) ABSTRACT

A process and a system for managing a bowling center, which includes one or more bowling lanes along which a bowl is rolled, one or more pin setting up machines at one end of the lane and one or more bowlers' bays at the opposite end of the lane, one or more overhead monitors or videos above the lane, one or more consoles or keyboards located at the one or more lanes, respectively, and allowing a user to enter data, an electronic control system set up to manage the bowling center, and in particular, a score program which calculates the score of the games played at the bowling center and displays the score, in particular at the respective overhead monitor. A visual signal is emitted at the respective lane to indicate that the lane is open and waiting for users.

25 Claims, 13 Drawing Sheets

(56) References Cited

U.S. PATENT DOCUMENTS

| | | | | |
|---|---|---|---|---|
| 6,088,004 | A | 7/2000 | Domae et al. | |
| 6,230,065 | B1 * | 5/2001 | Tsujita | 700/92 |
| 6,270,421 | B1 | 8/2001 | Tsujita | |
| 6,304,789 | B1 | 10/2001 | Shea | |
| 6,325,725 | B1 * | 12/2001 | Tsujita | 473/70 |
| 8,066,572 | B1 * | 11/2011 | Timmons et al. | 463/42 |
| 8,070,575 | B2 * | 12/2011 | Mruk | 463/13 |
| 8,628,428 | B2 * | 1/2014 | Vaioli | 473/67 |
| 8,687,066 | B2 | 4/2014 | Vaioli | |
| 2010/0134687 | A1 | 6/2010 | Vaioli | |
| 2010/0173719 | A1 * | 7/2010 | Simeone | 473/70 |
| 2011/0223983 | A1 * | 9/2011 | Schwartz et al. | 463/17 |
| 2012/0326985 | A1 | 12/2012 | Baraldi et al. | |
| 2013/0237335 | A1 | 9/2013 | Meigs et al. | |
| 2014/0200693 | A1 | 7/2014 | Vaioli et al. | |

OTHER PUBLICATIONS

Office Action for related U.S. Appl. No. 14/086,149, dated Apr. 21, 2015, 7 pages.

* cited by examiner

BOWLING PROCESS AND SYSTEM FOR PROVIDING PICTORIAL REPRESENTATIONS OF A SCORE

BACKGROUND OF THE INVENTION

1. Field of the Invention

This invention relates to a process and a system for managing a bowling centre.

2. Discussion of Background Information

Typically, a bowling centre comprises a plurality of bowling lanes, pin setting up machines at one end of the lanes and bowlers' bays at the opposite ends of the respective lanes.

In known bowling centres there are also overhead monitors, or videos, mounted above the lanes, and one or more consoles, or keyboards, at the one or more lanes to allow the users, or bowlers, to enter data and commands.

A known bowling centre typically also comprises an electronic control system which is designed to manage operations in the bowling centre and which, in particular, implements the score program which uses the signals at the pin setting up machine to calculate the score of the match and to display the score on the respective overhead monitor.

In its typical configuration, the control system comprises an electronic processor which manages the score program and communicates with a respective electronic processor at the lane, with the pin setting up machine and with the console, which is typically a keyboard, but which might also be in the form of a joystick or other suitable device situated at the bowlers' bay at the lane.

This type of configuration is one of the reasons why traditional bowling centres are unable to extend their capabilities to make playing bowling much more fun for the patrons of the bowling centres.

In particular, one problem felt by patrons is the difficulty of finding their way to the lane assigned to them for their game. Indeed, the number identifying a lane is normally located at the end of the lane itself, in particular at the pin setting up machine, and can be rather difficult to see from positions far from the lane.

In practice, identifying the lane where a game is to take place is not easy and can in fact be very annoying and time wasting.

SUMMARY OF THE INVENTION

Generally speaking, therefore, the need is felt in the trade to improve the experience which bowlers and patrons can enjoy at the bowling centre.

Another need felt in the trade is to help bowling centre staff to work more efficiently and to avoid as far as possible situations where staff are overburdened with work.

This invention therefore proposes a new solution as an alternative to the solutions known up to now and, more specifically, proposes to overcome one or more of the above mentioned drawbacks and/or problems and/or to meet one or more of the needs felt in the trade or inferable from the above.

It is accordingly provided a process for managing a bowling centre as in the respective appended claims, which are incorporated into the detail description of the present invention in their entirety.

It is also provided a system and method for controlling or managing a bowling centre as in the respective appended claims, which are incorporated into the detail description of the present invention in their entirety.

BRIEF DESCRIPTION OF THE DRAWINGS

These and other innovative aspects, or advantageous features are set out in the appended claims and the technical features and advantages of the invention are apparent from the detailed description which follows of preferred embodiments of it, to be considered purely as non-limiting examples. The description is made with reference to the accompanying drawings, in which:

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
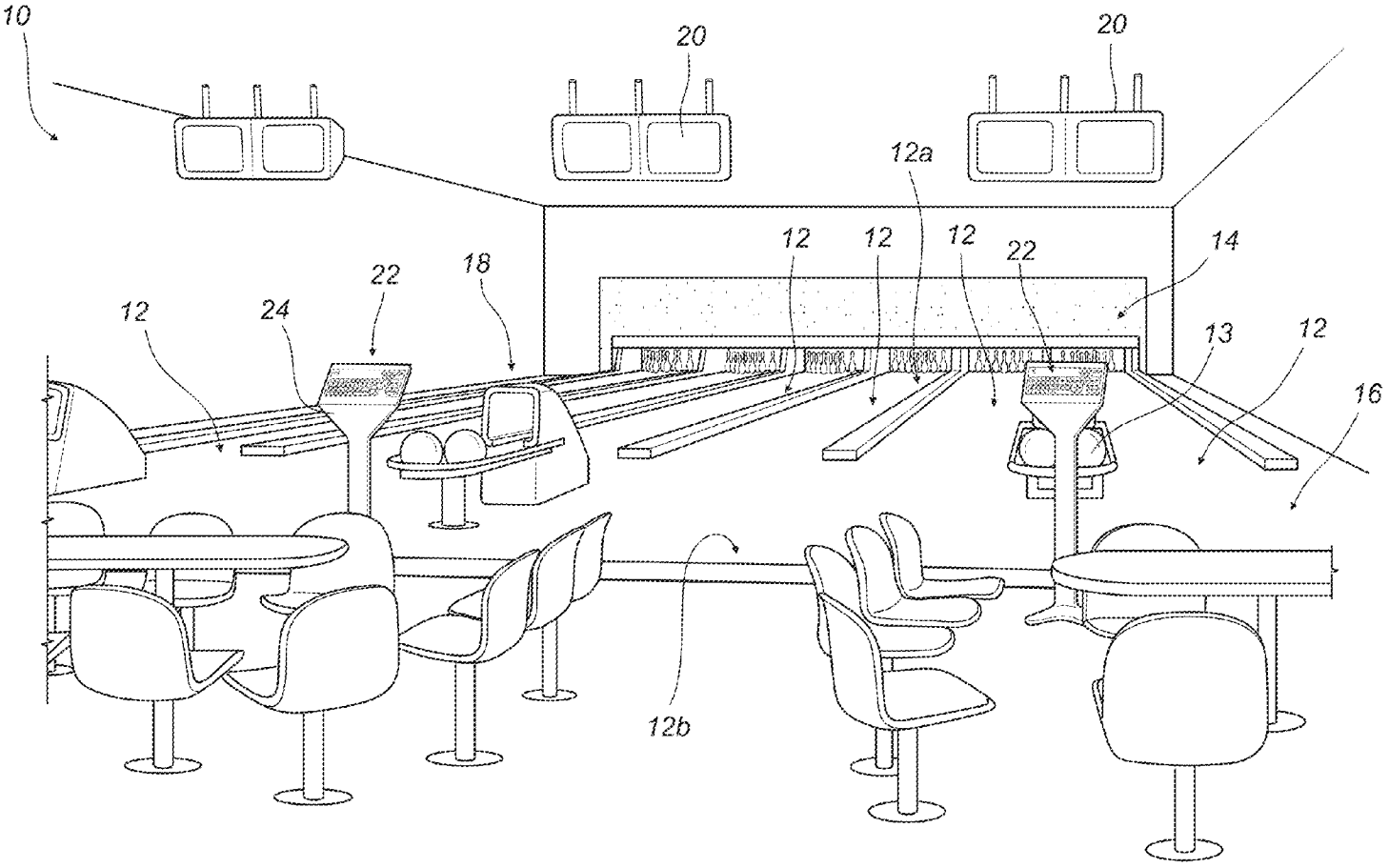
FIG. 1 is a schematic perspective view of a first preferred embodiment of a bowling centre.

FIG. 1 illustrates a bowling centre or bowling alley 10 which comprises one or more bowling lanes 12 along which a bowl 13 is rolled, the bowl 13 shown in the drawing being at the end of the lane where the bowls are collected by a device 18 which returns them to the throwing zone. The bowling centre also comprises a pin setting up machine 14 at one end 12*a* of the lane and a bowlers' bay 16 at the opposite end 12*b* of the lane.

As illustrated, the bowling centre further comprises overhead monitors or videos 20 above the lane 12, and a number of consoles 22 located at the one or more lanes, respectively, and allowing a user to enter data and commands. As illustrated, preferably, each console 22 in the bowling centre is mounted on a respective stand 24. More specifically, in the first preferred embodiment of the bowling centre system, the console 22, which is the data entry device used by the bowlers at each lane 12, is a console with illuminated keys. More specifically, the console 22 is the one described in Italian patent application B02011U000039 which is in the name of the same applicant as this invention and which is incorporated herein by reference.

The bowling centre also comprises an electronic control system which is set up to manage the bowling centre, and in particular, the score program, that is, the program which calculates the score of the games played at the bowling centre and displays that score, in particular at the respective overhead monitors 20.

Figure 3:
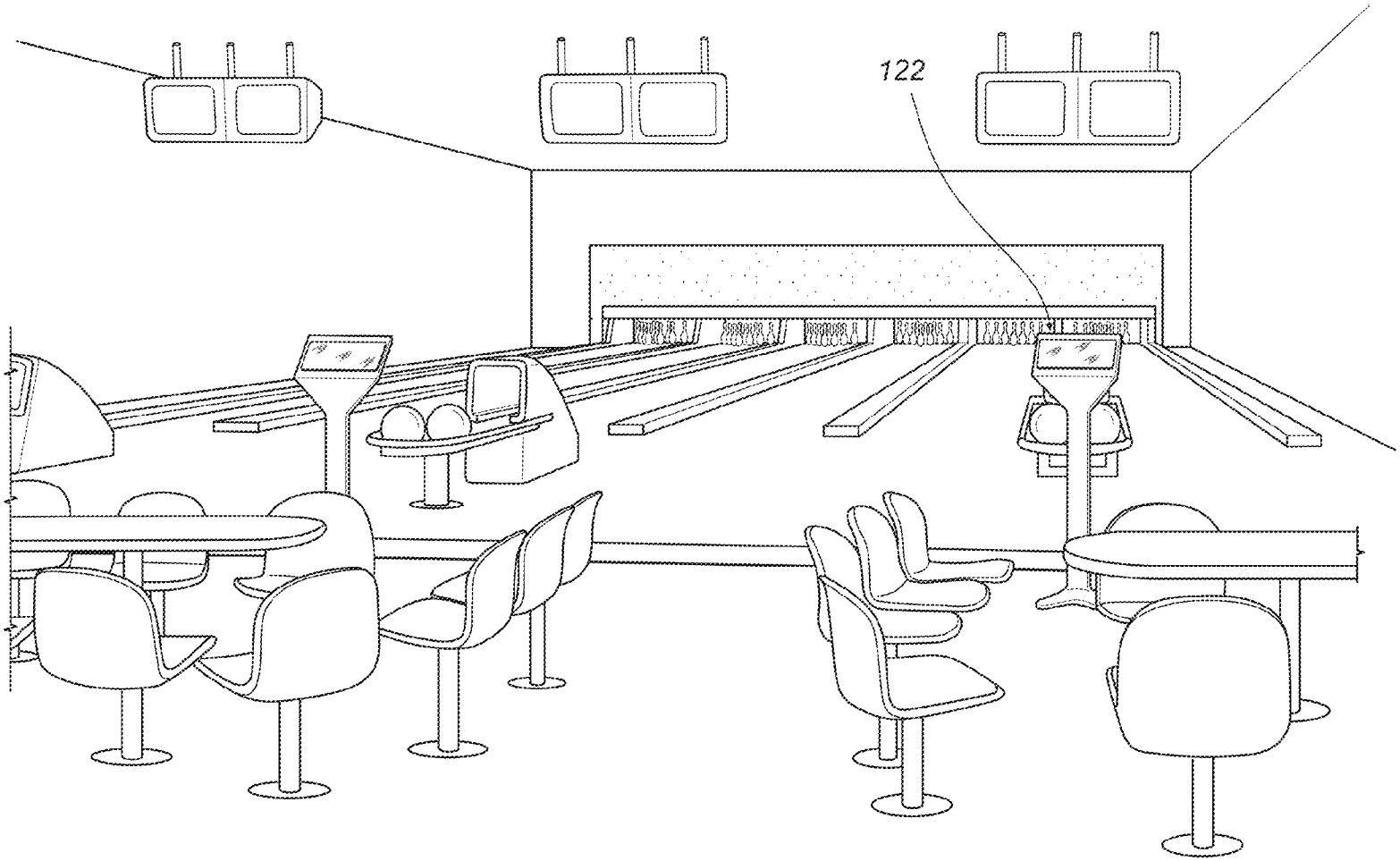
FIG. 3 is a perspective view of a second preferred embodiment of the bowling centre.

As may be inferred from FIG. 3, in a second preferred embodiment of the bowling centre, where most of the mechanical and electronic devices are the same as those described above and will not be commented upon again in detail so as to avoid making this description too lengthy, there is provided at the bowlers' bay 16, unlike the first preferred embodiment, a lane monitor of LCD type which is in the form of a touch screen monitor and which therefore constitutes the corresponding lane console 122.

Figure 4:
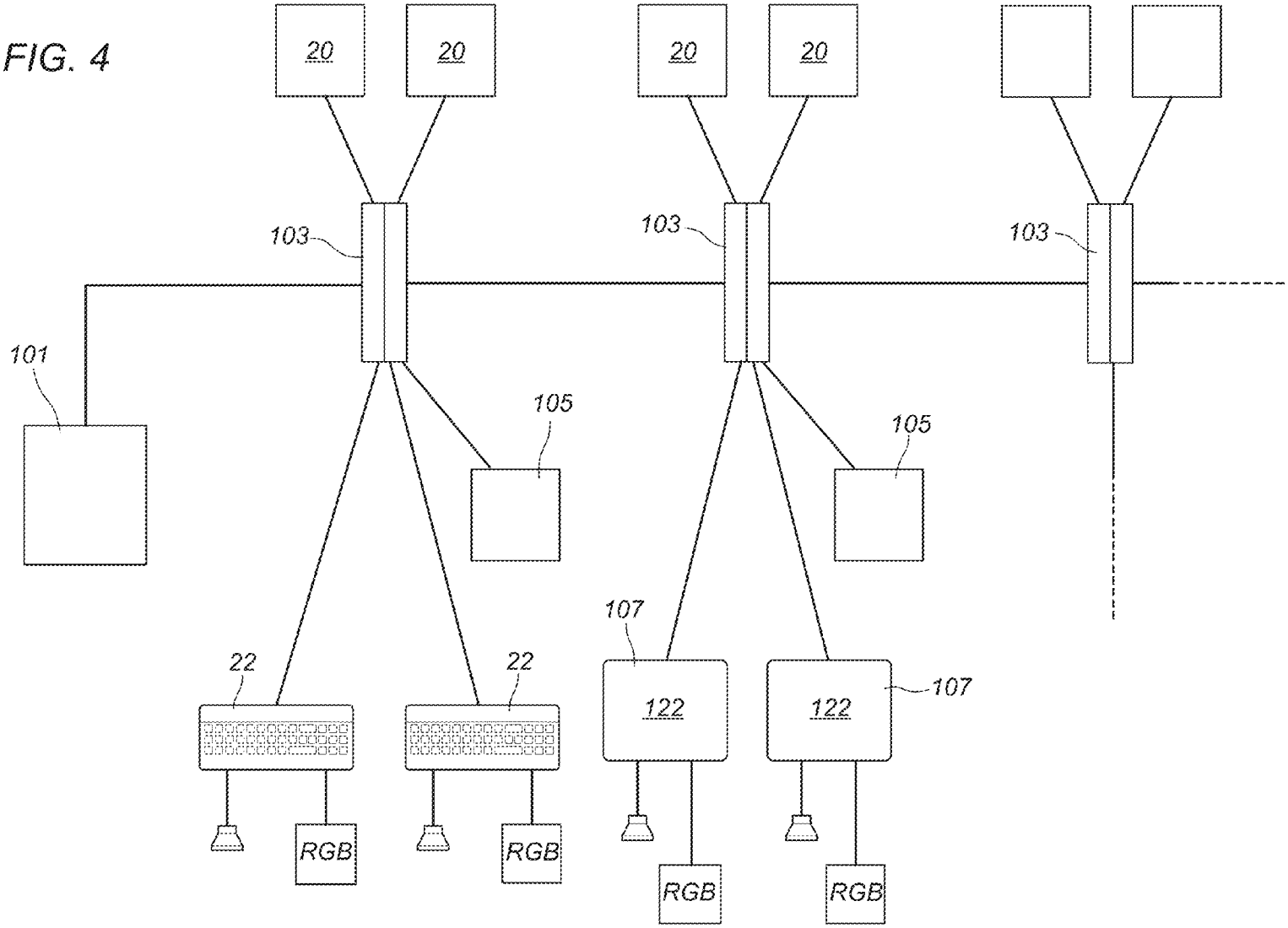
FIG. 4 is a block diagram applicable to both the first and second embodiments of the bowling centre.

As may be well inferred from the block diagram in FIG. 4, which applies to both the first and second embodiments of the bowling centre, the electronic control system comprises a main electronic processor 101, in particular in the form of a Windows PC, in communication with a plurality of local electronic processors 103 at the lanes, in particular in the form of Linux PCs, which are in turn connected to means for controlling the pin setting up machine 105 and to the lane consoles 22, 122, in particular to the means 107 for controlling the same. Each local electronic processor, or lane processor, 103 is also connected to the respective overhead monitor 20. The main electronic processor 101 implements the score program in known manner, using the data received from each electronic lane processor 103 to calculate the score of each of the games played at the bowling centre, and displays that score at the respective overhead monitor 20. Advantageously, the local electronic processor, or lane processor, 103 is also set up to control and manage the score program.

In practice, the local or lane electronic processor 103 is configured to directly implement the game score and to display it on the corresponding overhead monitor 20 and/or on the lane monitor 122, possibly and preferably, instead of the main processor 101 implementing the score program. In practice, the control system comprises, at the bowlers' bay, in particular at the lane console, an electronic processor 122 which can implement software functions and applications independently of the main processor 101 and of the lane or local processors 103.

Advantageously, a visual signal is emitted at the respective lane 12 to indicate that the lane is open, ready for a match or game to start and waiting for the bowlers to start playing. That way, bowlers can rapidly and confidently find their way to the lane assigned to them. More specifically, the visual signal indicating the lane 12 is emitted by the respective overhead monitor 20 and is, in particular, in the form of a static or animated image or a video clip displayed on the overhead monitor 20. The visual signal indicating the lanes 12 might also be emitted by a visual signal emitting device at the bowlers' bay 16. More specifically, in the first embodiment, the visual signal emitting device is defined by the console 22 at the respective lane 12, which, as stated above, is in the form of a console with illuminated keys.

Figure 2:
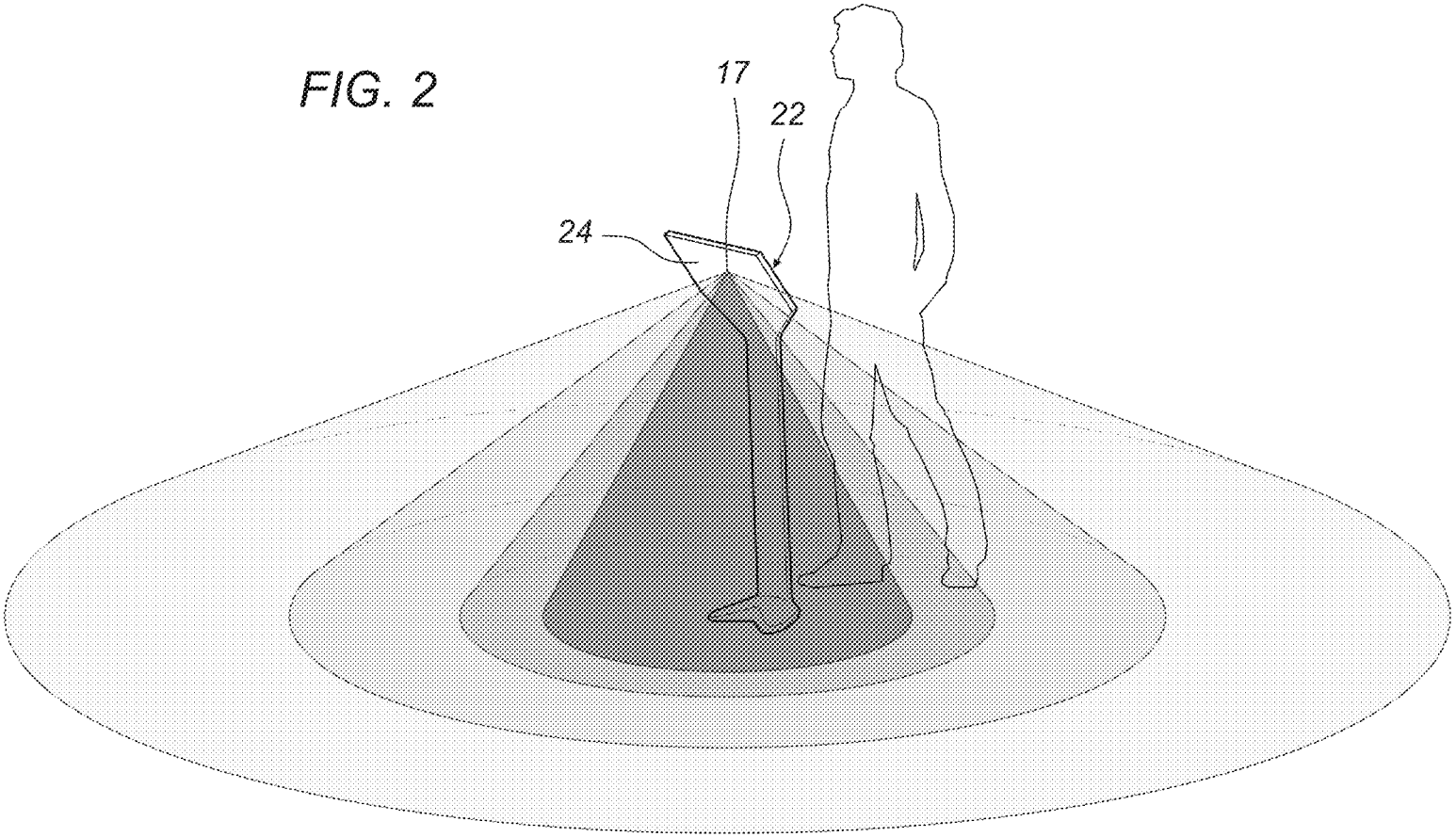
FIG. 2 is a schematic perspective view of a console located at the bowlers' bay.

With reference in particular to FIG. 2, it may be inferred that the visual signal might also be emitted, if necessary simultaneously, by a light source, in particular a LED 17, at the bowlers' bay 16 and, more specifically, at the console 22, mounted especially on the opposite side of the console stand 24. More specifically, the light source or diode 17 is mounted on the surface which the console 22 rests on and is directed downwards to emit light at a desired frequency or of a desired colour. More specifically, the visual signal emitted by the diode 17 might be in the form of an intermittent visual signal.

In the second embodiment of the bowling centre, the visual signal indicating the lane waiting for the bowlers to arrive, may be emitted by the LCD monitor of the console 122, in particular in the form of a static or animated image or video clip different from the one displayed on the respective overhead monitor. In particular, it is imaginable for the visual, lane waiting-to-start signal to be emitted simultaneously by the respective overhead monitor and by one or more visual signal emitting means at the bowlers' bay.

Figure 5A:
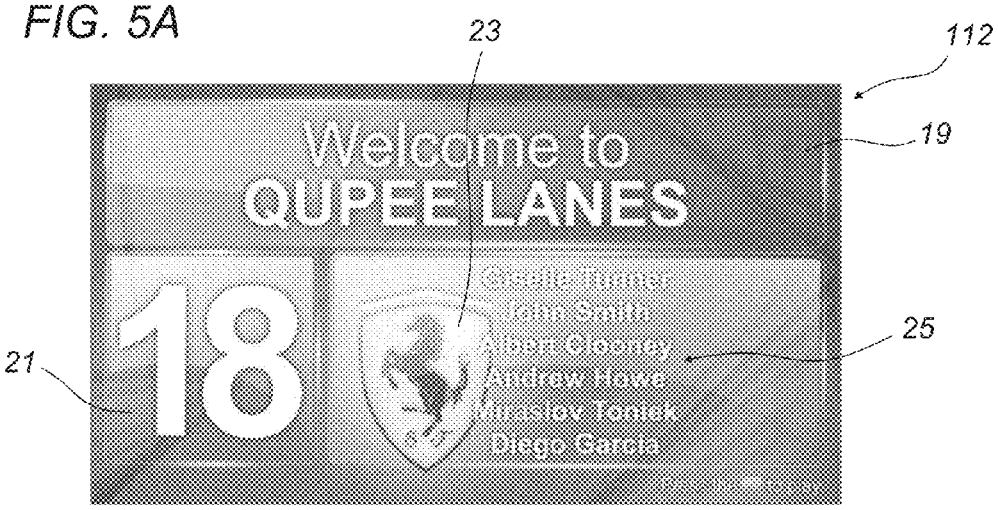
FIGS. 5A to 5C illustrate corresponding screen displays which welcome the bowlers to a lane.
Figure 5B:
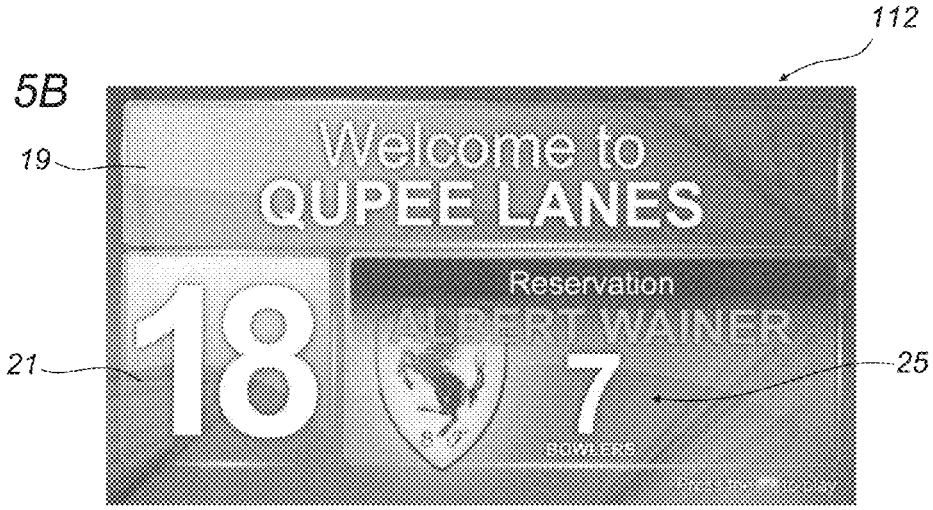
Figure 5C:
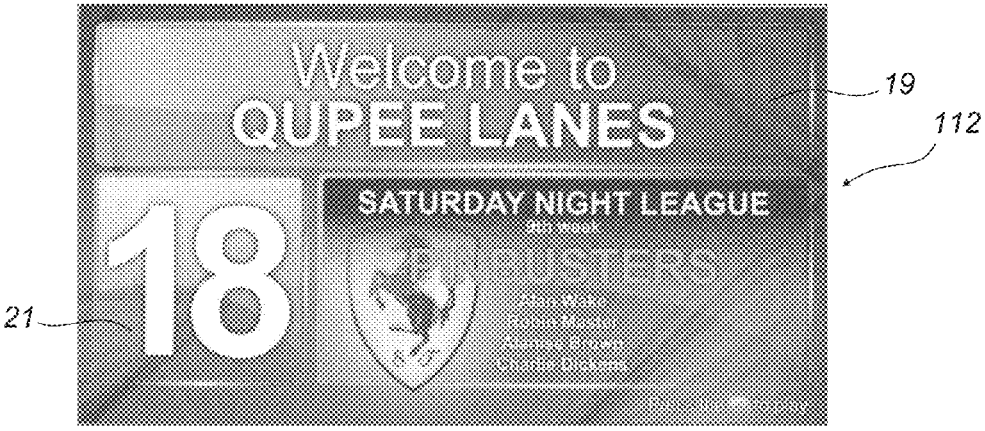

More specifically, as may be inferred from FIGS. 5A to 5C, which illustrate the second preferred embodiment of the system, a screen display or user interface, in particular at the LCD touch screen monitor, allows emitting a customized visual signal for the bowlers and/or for a specific event. More specifically, the screen display might comprise an image defining a welcome message 19, a lane identification number 21, a logo or drawing 23 representing the bowler or bowlers, in particular the team of bowlers, a customized screen colour, alphanumeric text 25 indicating the bowlers' names, the team and team members, and, in particular the number of bowlers. More specifically, as illustrated, the welcome message appears at the top of the screen, the lane number on one side of the bottom section of the screen, and the text 25 regarding the bowlers and the specific event, in the central, right-hand side of the bottom section of the screen. The logo or drawing 23 appears in the central, right-hand bottom section 25.

In practice, it is imaginable that the signal displayed or on-screen interface, indicating that the lane is open and available to a user or users comprises one or more of the following items: the lane number, the names of the bowlers, the name of the team the bowlers belong to, the name of the tournament or championship in progress, the team logo, the photos of the bowlers.

Preferably, the signal displayed or on-screen interface, indicating that the lane is open and available to a bowler or bowlers, that is to say, welcoming the bowlers to the lane assigned to them, comprises items which are known to the central management system of the bowling centre. Thus, an image relating to the lane which is being opened can be generated by the bowling centre control system automatically and without the bowling centre operator having to take any specific action.

It will be understood, however, that when the lane is opened, whatever the case, the operator might add further items, provided by the customer and to be displayed at the lane such as, for example, images in jpeg format, specific text or video clips.

In practice, the content to be displayed is preferably predetermined and automatically controlled by the centralized control system of the bowling centre, with the possibility of the operator adding information, if necessary.

As already mentioned, although it is preferable for the welcome message displayed to be in the form of a static image, as illustrated in the drawings, the welcome message might also be entirely or partly in the form of a processed animated sequence of two- or three-dimensional images.

After reaching the lane, the bowlers must, according to the implementing system or program, declare their presence using the keyboard or LCD touch screen, thereby clearing the welcome message and starting the game. Alternatively, the implementing system or program might simply clear the welcome message when the game is started. In that case, the bowlers might simply be prompted to proceed directly to playing when ready by an on-screen message or, if necessary, by any other suitable method. In that case, bowlers need not interact with the keyboard or LCD touch screen.

According to another advantageous aspect, a bowling centre user or bowler might be provided, for personal use, in particular outside the bowling centre, with a copy of the multimedia contents or images displayed at the monitor 20, 122 of the respective lane 12. More specifically, this copy might correspond totally or partly to the multimedia contents or images displayed in the bowling centre. That way, the customer may take away on a respective storage medium or receive in digital format a static image (for example, printed to a respective storage medium) or an animated image or video clip made using graphical or visual images present or generated at the bowling lane.

More specifically, the image (printed, if necessary) or video clip might include contents posted to Facebook® of the bowling centre management system, in particular those generated during a game or match, as will become clearer as this description continues. These images or video clips might by printed or reproduced on other material or objects to be used in other life situations or events, such as, for example, a birthday party. These images or video clips might, for example, be printed on cups, table covers or napkins or they might be reproduced on other media to be used on such an event. In other words, they might, for example, constitute a birthday party kit. Further, if the bowling centre offers a customized video game service, as will be described in more detail below and which involves a customized graphical result on the monitor, these images may be printed or sent digitally to the customer. Also, if the system allows the production of screen backgrounds with the photos of the bowlers on an existing graphical base produced in the bowling centre, the customer may be provided with images or video clips obtained from what is displayed on the lane monitor and/or at the LCD lane console 122.

In practice, the photos and static or animated images used or displayed in the bowling centre, in particular at the lane, may become items given to users in various ways, for example, in the form of files sent by email or posted to the user's Facebook® page or in physical form such as, for example, a hard copy printed by the front desk operator and delivered to the customer, or a CD/DVD containing the images or video clips. Preferably, the images or video clips or other material are generated at the lane and sent to the centralized control means 101, which then makes them available both to the operator (in charge of physical delivery) and to the system of automatic delivery, via email or posting to the user's Facebook® page. The images or video clips generated might advantageously be in the form of group photos or images, that is, photos or images comprising two or more participants in the specific event, birthday party, match or other, and might by generated by a program implementing what is described in European patent application No. EP 2170472, which is in the name of the same Applicant as this description and whose contents are incorporated herein by reference.

According to another advantageous feature, illustrated in FIGS. 6A to 9, the invention contemplates implementing a video game, in particular running on the same hardware on which the score software runs, in particular on the monitor or LED 22 or on the lane monitor 122, and where the respective game sequence is controlled by the result of the throw of a bowl, as detected by the score program. More specifically, the result of the throw of a bowl might consist of one or more of the following events or combination of one or more of the following events: the number of pins knocked down, the arrangement of the pins knocked down, the speed of the bowl and possibly the skill level declared by a bowler or derived automatically from that bowler's game performance.

Figure 6A:
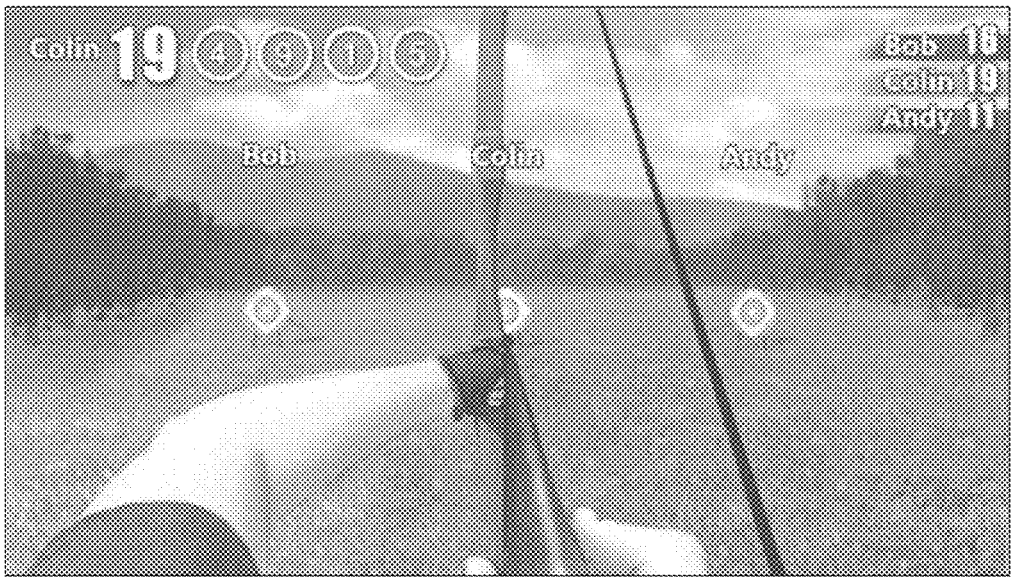
FIGS. 6A and 6B show respective images displayed on a respective screen display and relating to a first embodiment of a computer game implemented in the bowling centre.
Figure 6B:
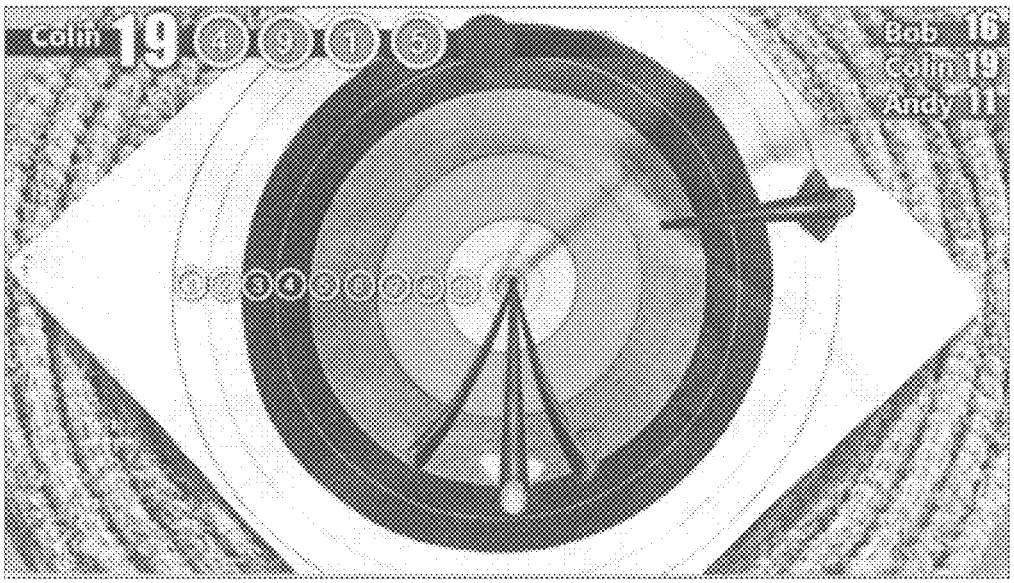

More specifically, a first preferred embodiment of the video game, illustrated in FIGS. 6A and 6B, involves hitting a numbered target, in particular with an arrow propelled by a bow. Different game sequences are available which involve hitting one of a number of different numbered zones of the target, depending on the result of the command received. In this game, the game sequence is selected as a function of the result of the bowler's throw of the bowl. After each throw, each bowler is presented with a respective target which summarizes the bowler's throws represented by an arrow which hits the respective numbered score zone of the target.

Figure 7A:
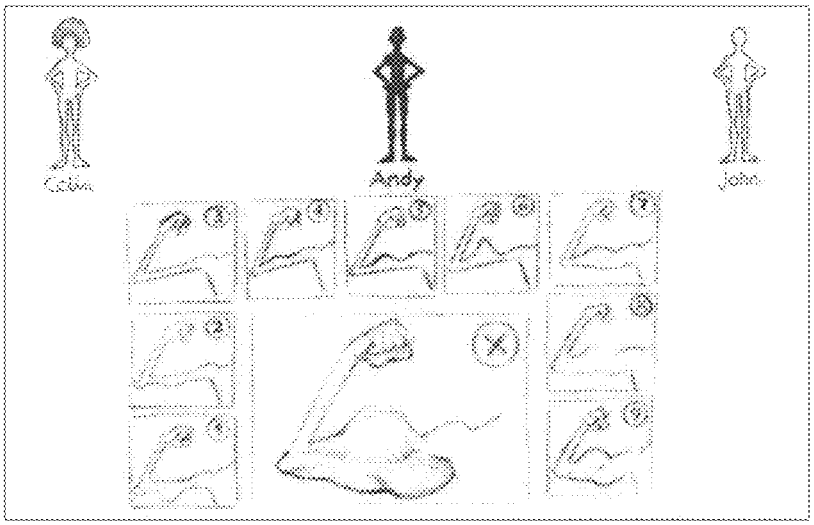
FIGS. 7A and 7E show respective images displayed on a respective screen display and relating to a second preferred embodiment of another computer game implemented in the bowling centre.
Figure 7B:
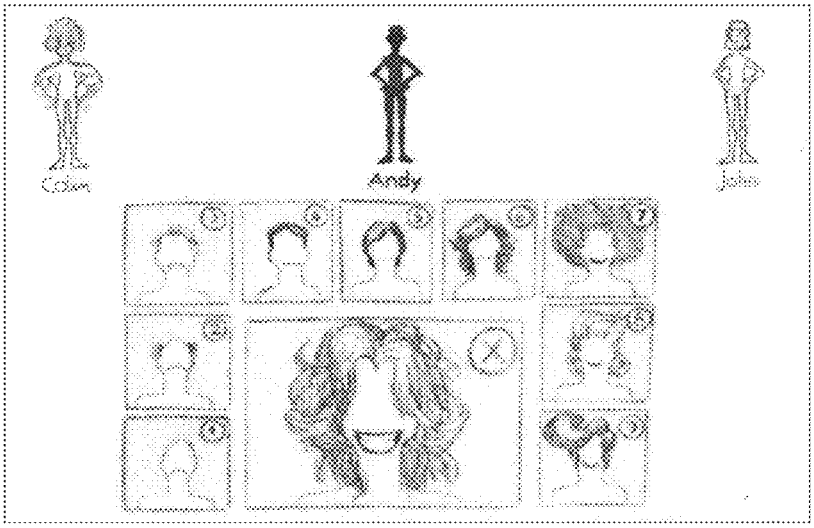
Figure 7C:
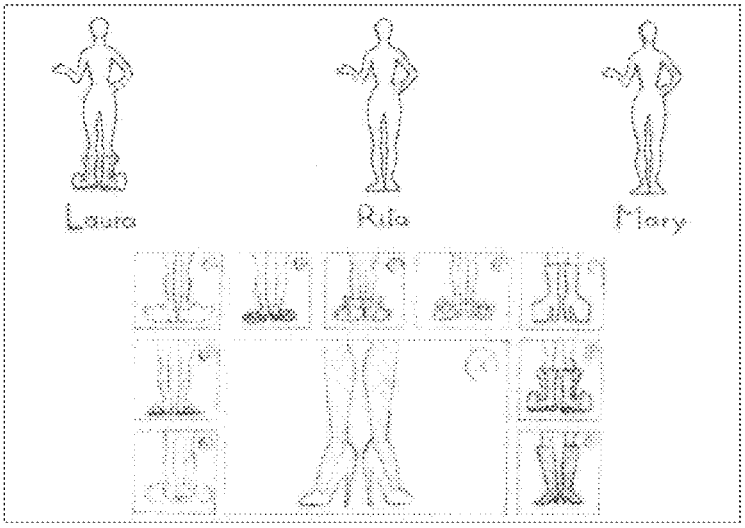
Figure 7D:
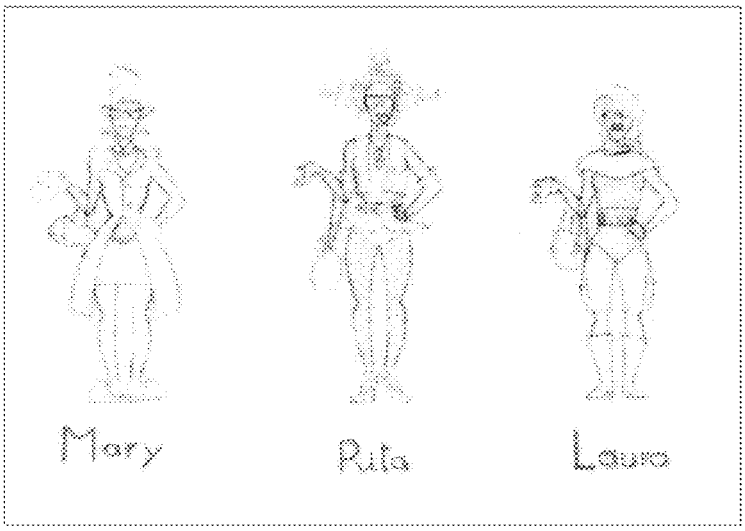
Figure 7E:
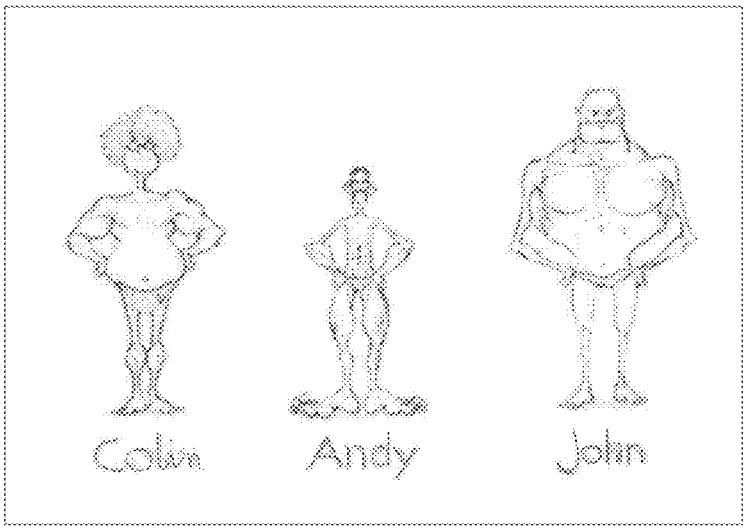
Figure 8:
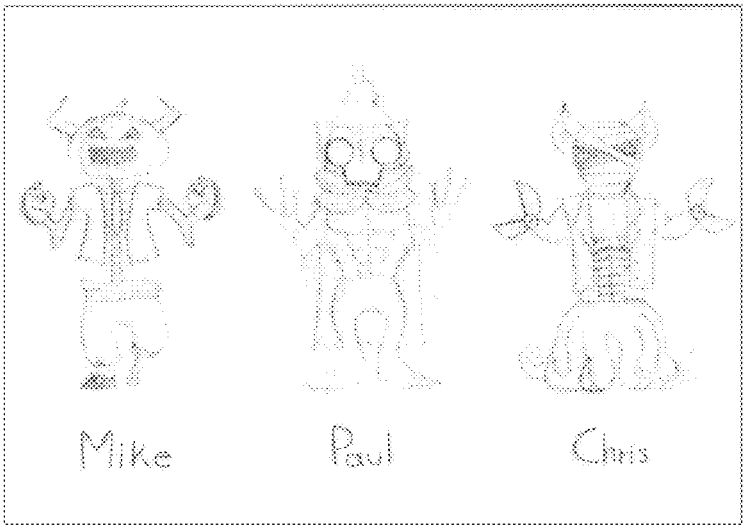
FIG. 8 shows respective image displayed on a screen display and relating to a third preferred embodiment of a computer game implemented in the bowling centre.

FIGS. 7A to 7E and 8 illustrate a second and a third preferred embodiment of the video game. In this case, the video game involves building the body of a character, in particular a funny character, as illustrated in FIGS. 7A to 7E, or a monster character, as illustrated in FIG. 8. A plurality of game sequences are available for each throw, each sequence being associated with choosing a part of the character's body from a plurality of parts available for that throw. It is also possible to have available a total number of parts which is greater than the number of parts available for the respective throw, so that the set of parts available for each throw is variable, in particular variable at random, thus adding variety to the game to make it less monotonous and more fun for the bowlers.

Each game sequence is selected as a function of the result of the throw of the bowl, that is to say, each component is associated with the result of a throw of a bowl and the component is then selected according to whether or not that result is achieved. For example, as illustrated, a throw might be associated with choosing the character's arm, as illustrated in FIG. 7A, whilst another throw might be associated with choosing the character's hair, as illustrated in FIG. 7B, or legs, as illustrated in FIG. 7C. In short, a male or female fun character is created, as illustrated in FIGS. 7D and 7E, or a monster character as illustrated in FIG. 8. The game might also be applicable to any other entity, different from the body of the character illustrated in the drawings.

Figure 9:
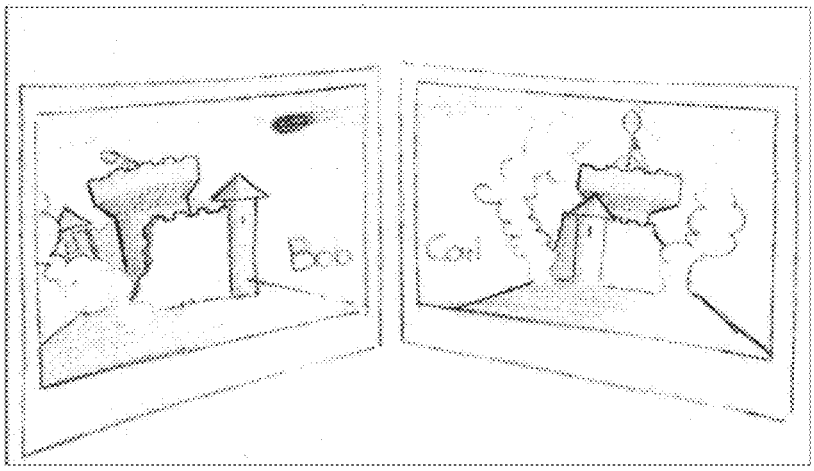
FIG. 9 shows respective image displayed on a screen display and relating to a fourth preferred embodiment of a computer game implemented in the bowling centre.

A fourth embodiment of the video game is illustrated in FIG. 9, which shows a first and a second construction, each assigned to a bowler or team. In this embodiment, the construction is in the form of a fortress or castle. The game might also be applicable to any type of construction or any entity other than the castle illustrated in the drawings. The game involves destroying the entity, in particular, the castle of the opposing bowler or team, and each throw of the bowl corresponds to propelling a projectile which strikes the entity of the opposing bowler or team. The game sequence, that is, the propulsion of the projectile, is selected as a function of the result of the throw of the bowl. In all the games described above, the specific sequence may be directly correlated with the result of the throw of the bowl or, to increase bowler fun, may be modified by random events and/or by the bowler's declared skill level.

In another, particularly advantageous procedure, a chat system is created within the bowling centre, to put the consoles 122 at the respective lane 12 in communication with each other. This constitutes a real and advantageous possibility of interpersonal communication within the bowling centre, even between bowlers playing at different lanes which are far from each other. Furthermore, the chat system might also be created to put in communication with each other different bowling centres and even users at the lane and the front desk, that is to say, the console 122 and the PC 101. When a chat message arrives, the RGB light of the console might be made to flash. The chat system might also include automatically sending predetermined messages, such as, for example, the message "Do not disturb".

A single electronic processor or server, for example the main one 101 of the bowling centre, would be assigned to managing internal chat traffic within the bowling centre, and another specific electronic processor or server would be assigned to managing chat traffic between different bowling centres.

Figure 10A:
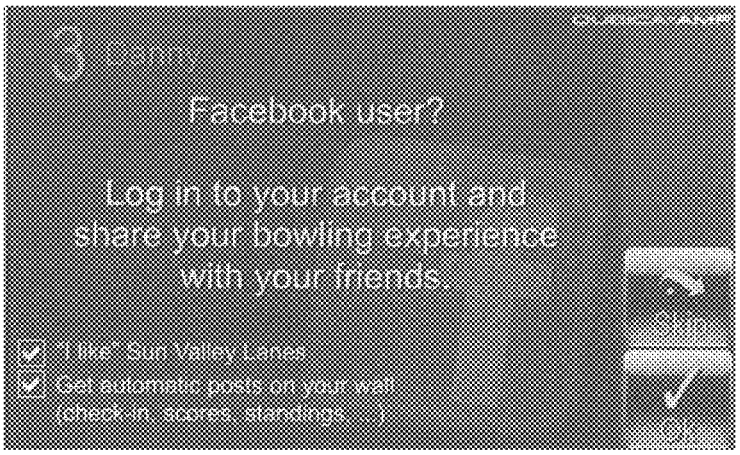
FIGS. 10A and 10B illustrate respective user interface screens for accessing the bowler's Facebook® (social network) page.
Figure 10B:
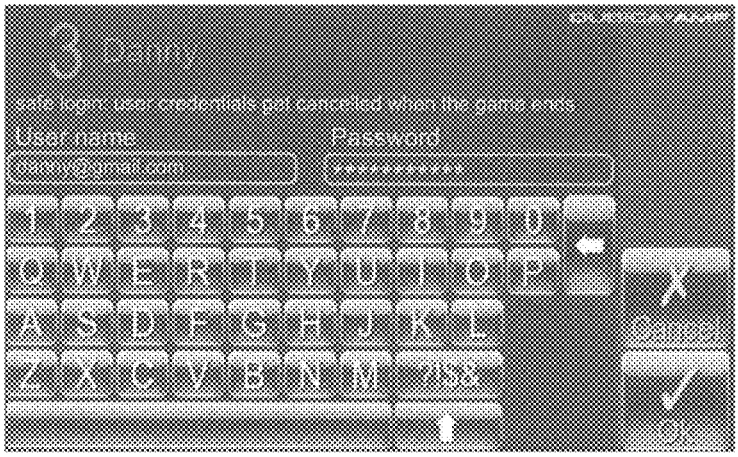

FIGS. 10A to 10C illustrate a further, advantageous procedure implemented by the bowling centre management system. More specifically, the bowling centre system can be placed in communication with the personal page in Facebook® or other social network of the user or bowler or group of bowlers, so as to post to this page the events that take place at the bowling lane. In particular, the lane console 122 preferably presents a user interface or screen which allows access to this service by entering the user credentials as provided in the bowling centre. Next, in another user interface, the user name and password must be entered to allow the score program to automatically post messages and events to Facebook®. Advantageously, therefore, the events that normally take place at the lane and which would normally be visible only at the lane, can be posted automatically to and viewed from the Facebook® page. This can be implemented, in particular, for events detected by the score program, such as: specific game results (triple strike, converted split, and others), game start and end events (welcome to tournament, scores, statistics, standings, and others) and images and video clips generated for the bowler, such as those described above.

In addition, it is possible to display a summary page for all the bowlers at the lane, representing all the events posted to the respective Facebook® page and containing the comments, if any, of other Facebook® users.

Figure 11A:
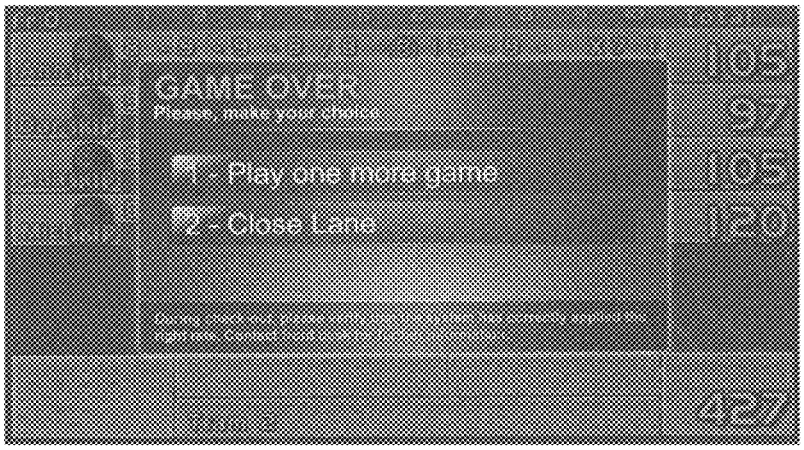
FIGS. 11A and 11B illustrate corresponding user interface screens as they appear to users and allowing play to continue for a chosen length of time.
Figure 11B:
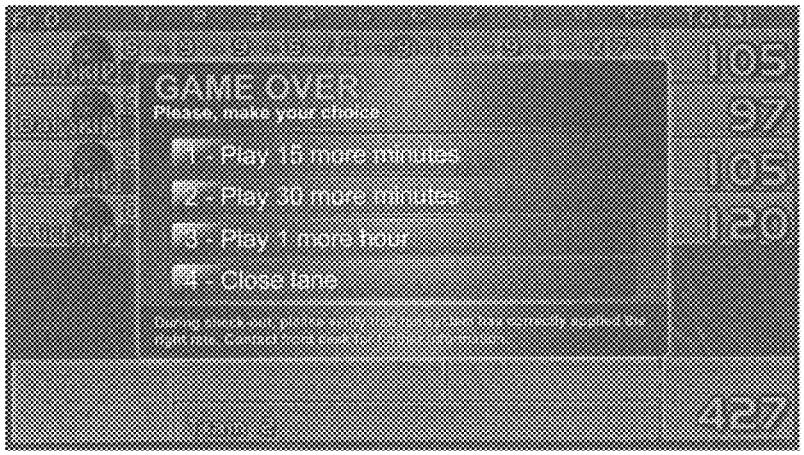

In another advantageous procedure, illustrated in FIGS. 11A and 11B, an interface or screen is displayed on the lane console or monitor 122 at the end of the preassigned game session, allowing the user to extend playing time directly from the lane console 22, 122. In practice, it is possible to continue playing by interacting automatically with the bowling centre management system even after the paid amount of time (or number of games) has been entirely used up. Formerly, to extend playing time, it was necessary to leave the lane, go to the front desk and ask the operator to assign more playing time.

Figure 12A:
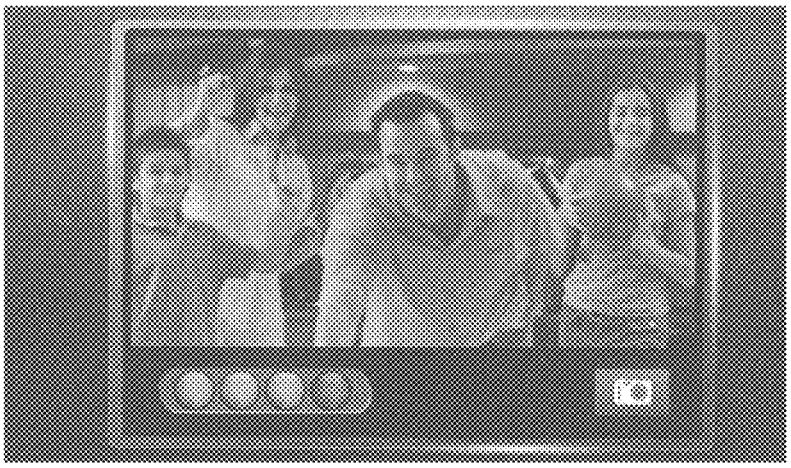
FIGS. 12A to 12D illustrate different interface screens displayed at the lane console and on the monitor of the front desk reception operator and allowing the bowler's photo to be used as background image for the scoreboard or score screen.
Figure 12C:
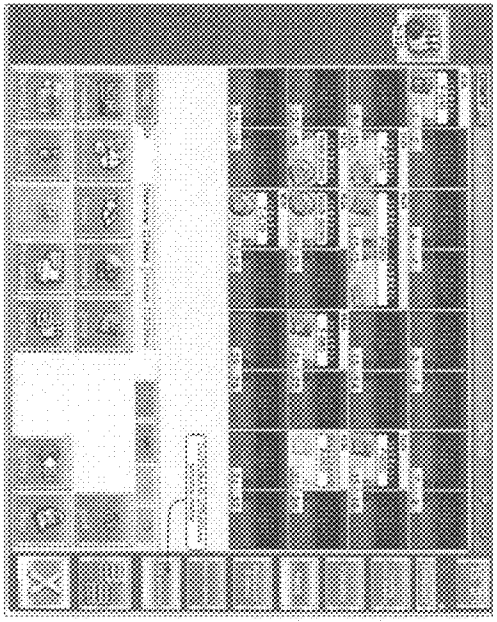
Figure 12B:
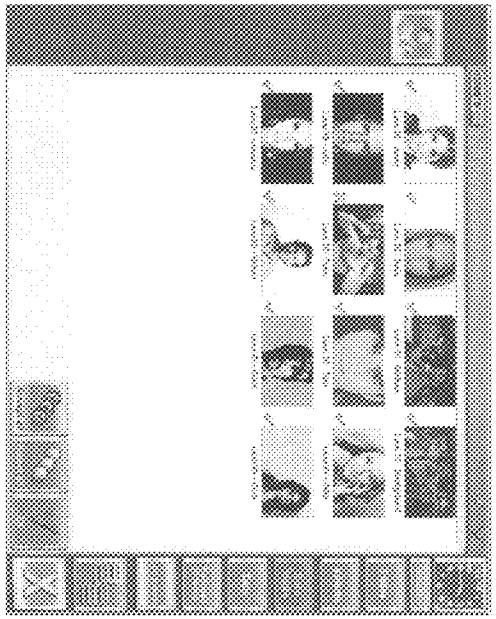
Figure 12D:
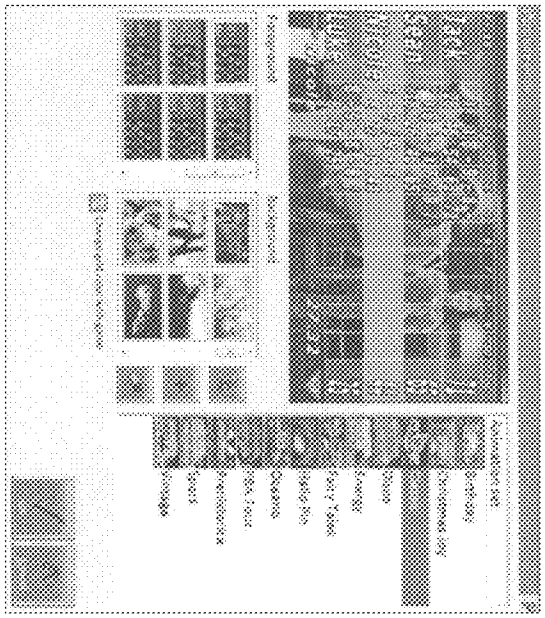

In another advantageous process, a photo of the bowler or user can be set as the background of the score screen. As may be inferred from FIGS. 12A to 12F, the photo can advantageously be taken at the lane using the video camera mounted at the lane console 122. In that case, the console monitor 122 presents an interface regarding the photo, as illustrated in FIG. 12A. The photo might, however, be imported automatically from the bowler's file or account using the operator interfaces, as illustrated in FIG. 12B, accessible by the bowling centre, in particular at the front desk. Whether the background photo is taken directly at the lane or retrieved from the bowler's file or account through the operator interface, as illustrated in FIG. 12C, that photo is assigned to the respective score screen of the respective lane. All this allows the current bowler at the lane to be better identified. In practice, the score screen background photo may be provided instead of, or in addition to, the bowler's name.

Also contemplated is an automatic procedure (which analyses the image with a specific software) or, alternatively, which allows the front desk operator to validate the photos before making them available on the lane console or monitor.

In another advantageous procedure, illustrated FIGS. 13A to 13D, putting the bowler or bowler in communication with an operator at the bar/restaurant of the bowling centre, through the lane console or monitor 122. More specifically, the process of the invention contemplates displaying a bowler or user interface comprising a list of the available products, including prices if necessary, the list being in the form of an image showing a menu 31. Thus, the bar or restaurant manager can at any time modify the day's menu for the bowlers at the lanes without having to manually print and physically distribute the menus to the bowlers' bays. The product list in the form of a menu is easier and quicker to read and identify, making it more enjoyable and convenient for the user to choose from than a plain alphanumeric list without the stylized or other eye-catching images of the products in this menu. In practice, the bowler or user interface comprises a list of the available products, including prices if necessary, in the form of an image showing a menu 31.

Also, advantageously, the bowler or user interface comprises a zone 33 for the image of the bowler or user making the call and a zone 35 for the image of the operator receiving the call, this area being activated when the operator replies and is ready to receive orders.

Figure 13A:
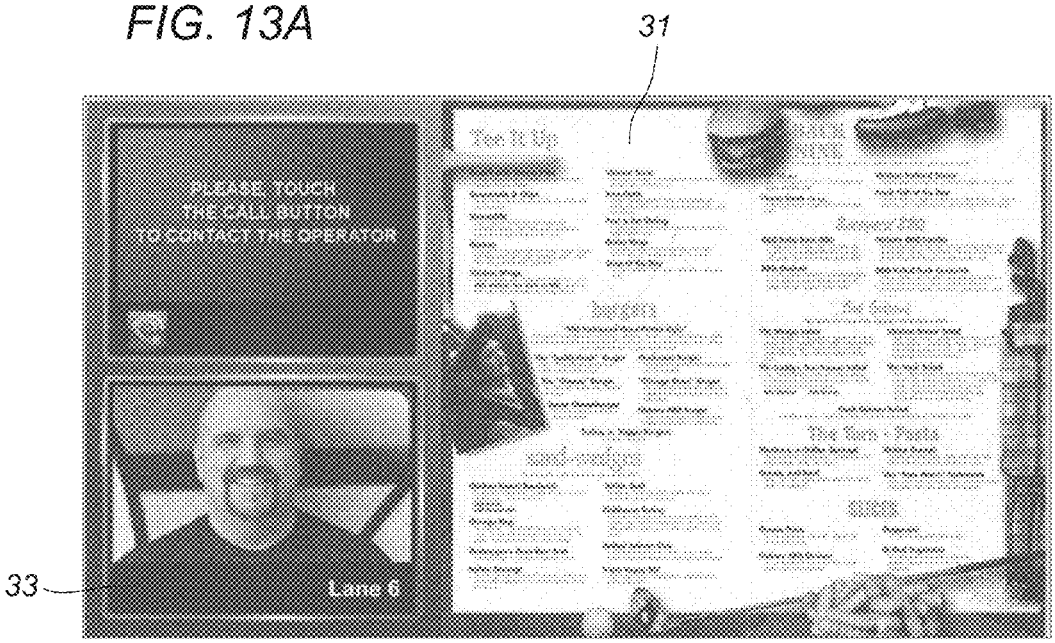
FIGS. 13A to 13D illustrate different interface screens as seen by customer and operator and showing the different steps of entering an order addressed to a product sales department inside the bowling centre, in particular an order to be sent to a bar/restaurant service.
Figure 13B:
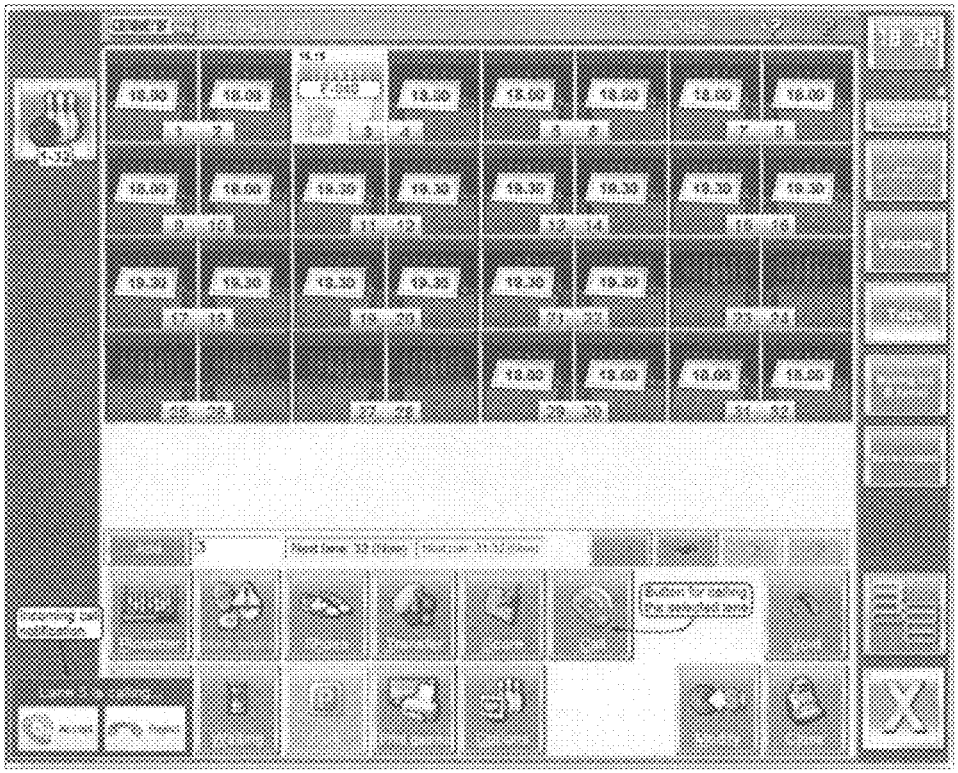
Figure 13C:
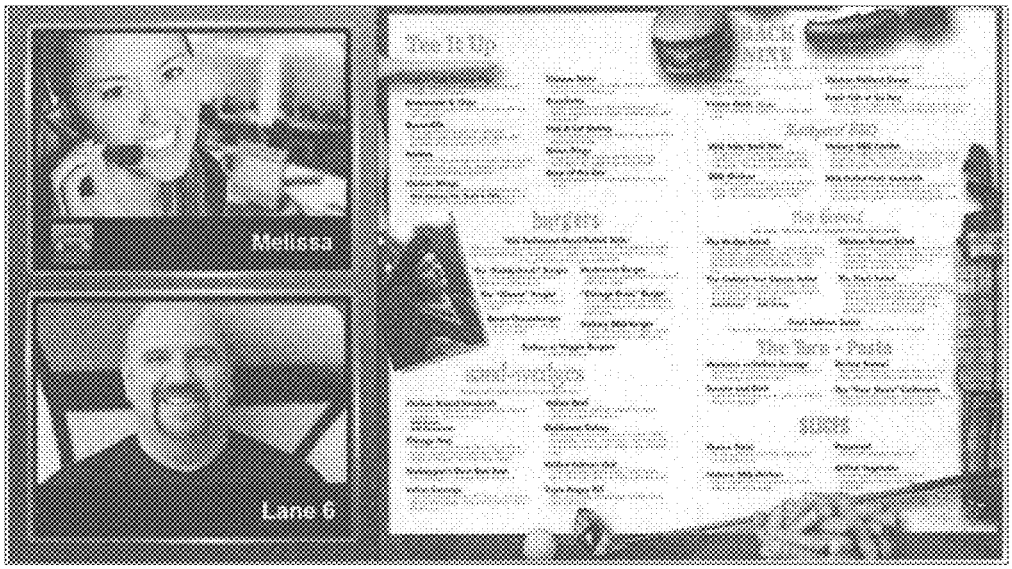
Figure 13D:
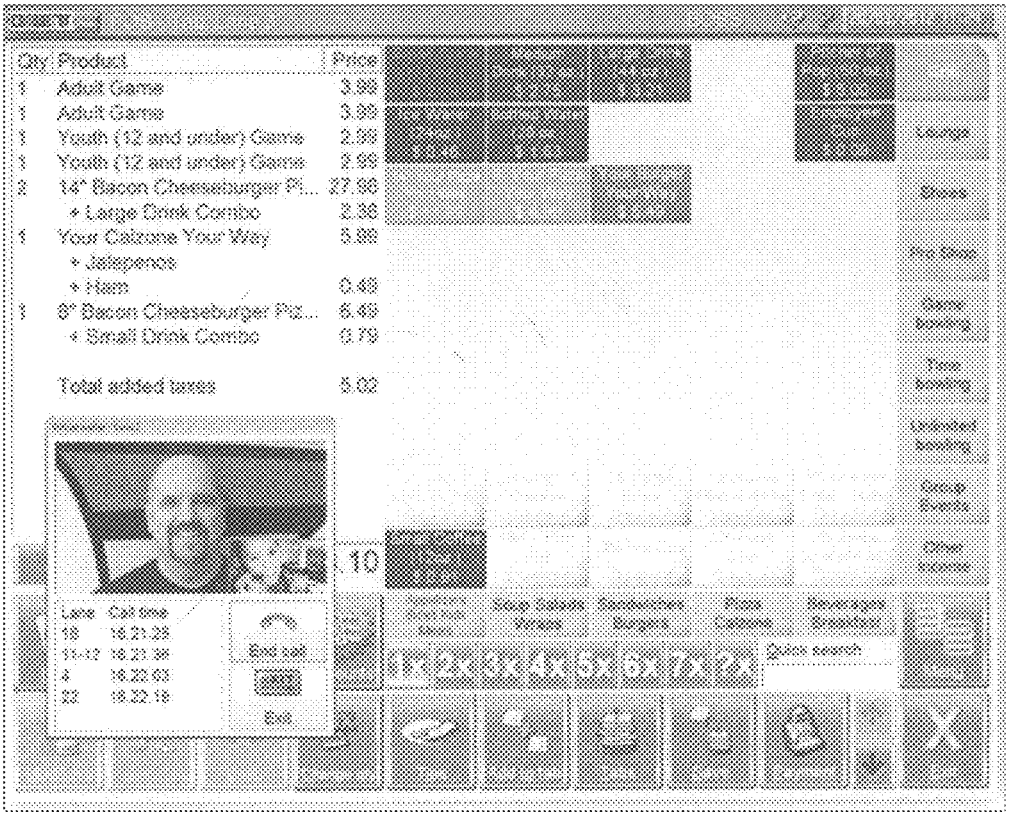

As illustrated in FIGS. 13B to 13D, once the bowler or user has made the call, the sequence comprises activating, on the operator interface of the bar or restaurant or other sales department in the bowling centre, an area corresponding to the lane or bowlers' bay from which the call was made. The operator can accept or reject the call. If the operator accepts, as illustrated in FIG. 13C, the corresponding area of the user interface at the lane console is activated and the image of the operator answering the call is displayed. At this point, the customer or bowler can speak directly to the operator to order the required refreshments or products, as shown in FIG. 13D. The operator uses an interface for taking note of the products selected by the customer, with prices and the total sum chargeable.

The invention described above is susceptible of industrial application. It would be obvious to one skilled in the art that several changes and modifications can be made to the invention without departing from the spirit and scope of the invention, described in depth above. It is also easy to imagine further embodiments of the invention comprising one or more of the features described herein. Moreover, it will be understood that all the details of the invention may be substituted by technically equivalent elements.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for providing pictorial representations representative of a score of a bowling game in a bowling center which is implemented in a computing infrastructure with a scoring software being executed thereon, comprising:

calculating, using an electronic processor which implements the scoring software, a score of a game based on a number of bowling pins which are knocked down by a bowler of the bowling game;

determining, using the electronic processor, whether or not a particular score was achieved based on the number of the bowling pins knocked down by a throw of the bowling ball of the bowler;

correlating, using the electronic processor, a plurality of individual pictorial representations of a video game to the score of the bowling game, as detected by the scoring software using the electronic processor and which was determined to meet the particular score, such that each individual pictorial representations is a function of a particular amount of the bowling pins knocked down in the throw of the bowling by the bowler of the bowling game; and displaying, using the electronic processor, the plurality of individual pictorial representations in a sequence on a monitor based on a result of the throw of the bowling ball, until the sequence of pictorial representations creates a full representation of a preselected picture on the monitor associated with the game and which is representative of a game played.

2. The process of claim 1, wherein the sequence of pictorial representations are provided on same hardware which runs the scoring software for the bowling game and the sequence of pictorial representations are a sequence of events controlled by the ball throw in the bowling game and which is detected by the scoring program.

3. The process of claim 1, wherein the sequence of pictorial representations are correlated with any of: a number of the bowling pins knocked down, arrangement of the bowling pins knocked down, speed of a bowling ball which knocks down the bowling pins and skill level declared by a bowler or derived automatically from a game performance of the bowler.

4. The process of claim 1, wherein the sequence of pictorial representations involves hitting a numbered target with an arrow propelled by a bow.

5. The process of claim 4, wherein after each throw of the bowling ball, each bowler is presented with a respective target which summarizes the bowler's throws represented by the arrow which hits a respective numbered score zone of the target.

6. The process of claim 1, wherein the sequence of pictorial representations involves building a character.

7. The process of claim 6, wherein a number of pins knocked down is correlated with a part to be added to the character.

8. The process of claim 7, wherein a set of parts available for each throw of the bowling ball is variable and a particular part is added to the character based on the number of pins knocked down.

9. The process of claim 6, further comprising at least one of: printing the character after a game, providing the character to the bowler in electronic format and posting the character to an account of the bowler.

10. The process of claim 6, wherein the character is a monster or representation of a female or male.

11. The process of claim 1, wherein the sequence of pictorial representations includes a representative construction of a structure assigned to a bowler or team.

12. The process of claim 11, wherein the sequence of pictorial representations is representative of destroying the structure of an opposing bowler or team.

13. The process of claim 1, wherein the sequence of pictorial representations is a non-numerical representation which is representative of the score, which would otherwise be a numerical score associated with the number of bowling pins knocked down.

14. A process for providing pictorial representations representative of a score of a bowling game in a bowling center comprising:

calculating, using an electronic processor which implements a scoring software, a score of a bowling game based on a number of bowling pins which are knocked down by a bowler of the bowling game;

generating, using the electronic processor, a non-numerical representation of the score of the game using a sequence of graphics which are different than a numerical score of the number of bowling pins knocked down by the bowler of the bowling game, such that each non-numerical pictorial representation is a function of a particular amount of the bowling pins knocked down in the throw of the bowling by the bowler; and displaying individually each non-numerical representation until the sequence of graphics which are displayed on a monitor associated with the bowling game creates a full representation of a preselected picture representative of a game played.

15. The process of claim 14, wherein the sequence of graphics are provided on same hardware which runs scoring software for the game and the sequence of graphics are controlled by a ball throw in the game and which is detected by the scoring program.

16. The process of claim 14, wherein the sequence of graphics are correlated with at least one of: a number of pins knocked down, arrangement of the bowling pins knocked down, speed of a bowling ball which knocks down the bowling pins and skill level declared by a bowler or derived automatically from a game performance of the bowler.

17. The process of claim 14, wherein:

the sequence of graphics involves hitting a numbered target with an arrow propelled by a bow; and after each throw of the bowling ball, each bowler is presented with a respective target which summarizes the bowler's throws represented by the arrow which hits a respective numbered score zone of the target.

18. The process of claim 14, wherein the sequence of graphics involves building a character, wherein a number of pins knocked down is correlated with a part to be added to the character.

19. The process of claim 14, wherein the sequence of graphics is representative of destroying a structure of an opposing bowler or team.

20. A system for providing pictorial representations representative of a score of a bowling game in a bowling center comprising:

a centralized management system having a processor and a database storing bowling lane information; and a scoring system provided at one or bowling lanes comprising a processor, the scoring system configured to:

run scoring software for the game which is based on a number of bowling pins which are knocked down by a bowler of the game;

correlate a plurality of individual pictorial representations of a video game to the game in which the bowling pins are knocked down by the bowler and which was determined to meet a particular score of the bowling game, such that each individual pictorial representations is a function of a particular amount of bowling pins knocked down in the throw of the bowling by the bowler of the bowling game; and display the plurality of individual pictorial representations in a sequence on a monitor based on a result of the throw of the bowling ball, until the sequence of pictorial representations on the monitor of the scoring system associated with the game creates a full representation of a preselected picture on the monitor associated with the game and representative of a game played;

wherein the score of a game is the pictorial representations which are different than the number of bowling pins knocked down by the bowler.

21. The process of claim 1, further comprising emitting a visual signal at a respective bowling lane to indicate that the bowling lane is open and ready for the bowler to play the game.

22. The process of claim 21, wherein the emitting the visual signal comprises emitting a static or animated image on the monitor.

23. The process of claim 14, further comprising emitting a visual signal at a respective bowling lane to indicate that the bowling lane is open and ready for the bowler to play the game.

24. The process of claim 23, wherein the emitting the visual signal comprises emitting a static or animated image on the monitor.

25. The system of claim 20, wherein the monitor emits a visual signal at a respective bowling lane to indicate that the bowling lane is open and ready for the bowler to play the game.

* * * * *